US010471340B2

(12) United States Patent
Rudell

(10) Patent No.: US 10,471,340 B2
(45) Date of Patent: Nov. 12, 2019

(54) SIGNAL BEAM ACTIVATED LIQUID RELEASE GAME AND ACTIVITY

(71) Applicant: Elliot A. Rudell, Torrance, CA (US)

(72) Inventor: Elliot A. Rudell, Torrance, CA (US)

( * ) Notice: Subject to any disclaimer, the term of this patent is extended or adjusted under 35 U.S.C. 154(b) by 0 days.

(21) Appl. No.: 15/724,734

(22) Filed: Oct. 4, 2017

(65) Prior Publication Data

US 2018/0093173 A1 Apr. 5, 2018

Related U.S. Application Data

(60) Provisional application No. 62/404,004, filed on Oct. 4, 2016.

(51) Int. Cl.

| | |
|---|---|
| ***A63H 23/10*** | (2006.01) |
| ***A63F 9/00*** | (2006.01) |
| ***A63F 9/18*** | (2006.01) |
| ***A63F 9/02*** | (2006.01) |

(52) U.S. Cl.

CPC ..... *A63F 9/18* (2013.01); *A63F 9/00* (2013.01); *A63F 9/0278* (2013.01); *A63H 23/10* (2013.01); *A63F 2250/0407* (2013.01); *A63F 2250/0428* (2013.01); *A63F 2250/1073* (2013.01)

(58) Field of Classification Search

CPC ..... A63H 23/00; A63H 23/12; A63H 33/00; A63H 23/10; A63F 9/00; A63F 9/18; A63F 2250/0407; A63F 2250/0421

See application file for complete search history.

(56) References Cited

U.S. PATENT DOCUMENTS

| | | | | | |
|---|---|---|---|---|---|
| 4,369,782 | A | * | 1/1983 | McGee | A42B 3/0406 2/410 |
| 4,526,366 | A | * | 7/1985 | Kenoun | A63B 67/00 273/349 |
| 4,772,028 | A | * | 9/1988 | Rockhold | F41G 3/2683 434/22 |
| 4,813,680 | A | * | 3/1989 | Rudell | A63F 9/00 273/138.1 |
| 5,197,292 | A | * | 3/1993 | McPherson | A42B 1/008 2/7 |
| 5,201,442 | A | * | 4/1993 | Bakalian | A45F 3/16 222/608 |
| 5,256,099 | A | | 10/1993 | Rudell | |
| 5,295,890 | A | * | 3/1994 | Myers | A63H 17/006 446/176 |
| 5,370,278 | A | * | 12/1994 | Raynie | A63H 33/00 222/144.5 |
| 5,474,486 | A | * | 12/1995 | Chilton | A63H 17/006 222/78 |
| 5,722,660 | A | | 3/1998 | Rudell | |
| 5,823,538 | A | * | 10/1998 | Goldfarb | A63F 7/0017 273/445 |

(Continued)

OTHER PUBLICATIONS

Compilation of Prior Commercial Products.

*Primary Examiner* — Eugene L Kim
*Assistant Examiner* — Alyssa M Hylinski
(74) *Attorney, Agent, or Firm* — Shane V. Cortesi

(57) ABSTRACT

A game that dispenses water onto a user is described, as well as methods of play and apparatuses for same. In some embodiments, water is dispensed from headgear after receiving a wireless transmission from a transmitter located on a gun, console or other device.

28 Claims, 14 Drawing Sheets

(56) References Cited

U.S. PATENT DOCUMENTS

| | | | | | |
|---|---|---|---|---|---|
| 5,979,900 | A * | 11/1999 | Goldfarb | A63F 7/0017 | 273/440 |
| 5,984,788 | A * | 11/1999 | Lebensfeld | A63F 9/0291 | 463/51 |
| 5,992,853 | A * | 11/1999 | Rudell | A63F 9/18 | 273/148 R |
| 5,993,428 | A * | 11/1999 | Hardge | A42B 3/0406 | 2/422 |
| 6,050,099 | A * | 4/2000 | Lopa | A42B 1/008 | 62/259.3 |
| 6,163,507 | A * | 12/2000 | Gholson | G04G 13/021 | 368/12 |
| 6,427,467 | B1 * | 8/2002 | Bell | A42B 1/008 | 2/181.6 |
| 2002/0109299 | A1 * | 8/2002 | Rudell | A63F 9/02 | 273/349 |
| 2007/0114301 | A1 * | 5/2007 | Blake | A45F 3/16 | 239/327 |
| 2007/0284391 | A1 * | 12/2007 | von Goeben | A63H 23/10 | 222/78 |
| 2009/0005167 | A1 * | 1/2009 | Arrasvuori | A63H 33/042 | 463/40 |
| 2015/0273502 | A1 * | 10/2015 | Bell | B05B 9/0816 | 239/153 |
| 2015/0342145 | A1 * | 12/2015 | Christianson | A01K 15/021 | 119/51.11 |
| 2018/0042327 | A1 * | 2/2018 | Taylor | A42B 3/285 | |

* cited by examiner

SIGNAL BEAM ACTIVATED LIQUID RELEASE GAME AND ACTIVITY

CROSS REFERENCE TO RELATED APPLICATION

This patent application claims the benefit under 35 USC 119 of U.S. Provisional Patent Application Ser. No. 62/404,004, entitled "Signal Beam Activated Water Release Game", filed Oct. 4, 2016, the contents of which are incorporated herein by reference in their entirety.

FIELD OF THE INVENTION

The invention of the present application is directed towards children's water toys.

BACKGROUND INFORMATION

Inventor cited on this application co-invented a very popular toy called WETHEAD (U.S. Pat. No. 4,813,680) that emits water as one of numerous plastic rods is manually removed to release stored water onto a wearer's head. Said patent is long-expired, and yet the toy WETHEAD continues to be a worldwide sales success. There is no disclosure nor anticipation of usage of any remote signal activation of water release. Typically gameplay involves the wearer of the device randomly selecting and then physically removing the release rod from his own hat as the result of a gameplay directive, such as a spinner. Alternative play, where another player physically removes a rod from a wearer's hat still requires physical contact and manual means to activate water release.

In 1998 a company called Toymax marketed a line of products called Laser Challenge that involved two or more players holding blaster-guns emitting infrared signals in the direction of an opponent. Each player also wore a vest that included an infrared receiver. When a signal from another player's gun was received by the receiver in a player's vest, score would be made and a sound would be emitted. One model of toy in that product line was called Cyber Splash Laser Challenge. It included a water container and a battery operated pump mechanism that sprayed water upward towards the face and chin of the player after a series of signals were received by the infrared receiver on the vest. Each player therefore held a blaster gun and wore a vest and water sprayed upward.

A product was marketed in the past that was based upon several patents (U.S. Pat. Nos. 5,722,660 and 5,992,853 "GAME WITH TIMED WATER RELEASE") by the inventor of this application. IN YOUR FACE is a multi-player game wherein one player stands in the center of a group of players and asks a question that must be acceptably answered, in turn, by each other player, all who are sitting in a circle. The player asking the question is holding a motorized timer and spray emitting game unit, and presses or releases a trigger to set or reset a timer. When a seated player answers unacceptably or does not answer in time, a spray is emitted from the game unit and sprays towards that player. The product did not incorporate any signal sending or receiving means, and was not intended to be worn by anyone.

In 1989 Pressman Toy Corporation released a product called HYDRO-STRIKE. It was a skill and action game, without any electronics or signal sending/receiving. There are no separate units to the game. Nothing is worn by a player. It is described in this manner: "Players sit at either end of the plastic board controlling two flippers with a goal in between them. A marble is released, and players try to shoot it into their opponent's goal. When a goal is scored, a jet of water shoots out spraying the losing player. No batteries are needed—just fill the tank with water and pump up the pressure". There is no timed nor electronic activation, and water release is the mechanical response of a ball striking a trigger mechanism.

Other toys have successfully provided children with the entertainment of getting wet in a competitive play situation. Inventor cited in this application also invented CONTACT ACTIVATED PRESSURIZED WATER RELEASE TOY, U.S. Pat. No. 5,256,099. That invention resembles a hand-held toy sword and requires one player to press a release valve at the front end of the toy onto the body of an opponent. There is no provision for remote signal-activated water release, nor for any interactive gameplay between players, other than physical contact.

Hasbro introduced a product in late 2016 called DUNK HAT. This toy has a water container situated atop one player's head, and two target plates, one on each side of the hat. Other players throw balls at the hat, trying to hit one of the plates, to activate the release of water onto the head of the player wearing the hat. There are no electronics, no sending of receiving of signals. This product requires that the wearer stand in position while objects are being thrown towards the target plates by other children, often with poor aim. The product provides a clear plastic eye shield panel to protect the wearer of the toy from being struck by a projectile.

Further, headsets have been tethered to laser tag guns. Some professional laser tag parks will provide a piezo speaker in a head-worn unit that can buzz to mildly irritate a player when they get "shot" by an opponent's light beam. There is no provision for water release onto the head of a player when they are struck by an opponent's light beam.

In addition, Hasbro (and before them, Milton Bradley Company) for many years has marketed an electronic console game called "SIMON" (1978) that requires players to push buttons in response to a programmed light sequence displayed by inner circuitry. Innumerable similar games requiring players to respond to a light-illumination sequence by pressing a button or in some other fashion activating a switch, have also been on the market, Atari's "TOUCH ME" (1974) game being a handheld example that admittedly inspired "SIMON" and then other games like Castle Toy's "EINSTEIN" (1979) and more recently Mattel's "LOOPZ" game (released in the 2000's) that provides a unique added feature of players passing their hands and arms through motion-sensing areas (to activate switches) in response to a timed light sequence. None of the prior art hints at or involves a water penalty, particularly a water penalty initiated by a signal from the play device to activate a release of water, from another playset component, onto the head of a player.

OBJECTIVES OF THE INVENTION

It is an objective of this invention to provide a toy that sprays or pours water or similar fluid spraying down onto the head of a player when a gaming activation event occurs. It is further an objective of this invention to provide a competitive play pattern wherein a player or players' actions can cause the release of liquid (preferably water) spraying or pouring down onto the head of at least one player by means of a remote signal activation being transmitted from a second component of the invention, whether the player activating the liquid release is the wearer of the head-worn unit, or a competitor wearing a similar head-worn unit. The aforementioned objectives are exemplary and not intended to limit the scope of the invention.

SUMMARY OF THE INVENTION

In some embodiments, the present disclosure provides a gameset comprising headgear such as a playhat (also referred to herein as a helmet) that is worn by at least one player. In certain embodiments, multiple players could each wear one of said playhats. The playhat(s) may each contain liquid, preferably water stored in a container, and may each contain electronics to receive a signal from a remote transmitter/sender unit. Transmitter/sender units could either be inside handheld blaster guns held by opponents, or could be situated inside a gaming console that could be played on a tabletop. In the embodiment involving a handheld blaster gun, when an opponent pulled a trigger and then successfully sent a signal or signals to an opponent's playhat receiver, water or another liquid may be released onto the head of the playhat wearer. In the embodiment involving a gaming console, when a signal is transmitted from said console as a result of some action by a player or players, a wireless signal from said game console may activate water release onto the head of a player wearing a playhat.

More particularly, in some embodiments, the present disclosure provides a gameset configured to emit a liquid onto a player comprising: headgear configured to be worn on a head of a player and comprising a receiver and a liquid reservoir configured to hold a liquid; and a remote device comprising a transmitter configured to transmit a wireless (dispensing) signal to the receiver; and at least one power source configured to power the transmitter and the receiver, wherein, upon reception of the wireless signal from the transmitter, the receiver is configured to cause the headgear to dispense the liquid from the liquid reservoir and onto the player's head. In other words, the wireless signal may be a signal that communicates to with the headgear to dispense the liquid onto the player's head. The "remote" device may be physically near the headgear (e.g., the remote device may be located a few feet in front of the headgear) but the remote device is preferably not attached to the headgear.

Optionally, the headgear comprises a hat and the receiver. Optionally, the headgear comprises a helmet comprising a chin strap configured to strap the helmet to a chin of the player. Optionally, the remote device is a toy gun comprising a handle and a trigger connected to the handle, and depressing the trigger is configured to transmit the wireless signal. Optionally, the wireless signal is an infrared signal. Optionally, the remote device is a console that further comprises at least one button configured to activate an electronic switch. Optionally, the remote device is a mobile phone. Optionally, the headgear is further configured to emit lights, sounds or combinations thereof in response to the receiver receiving the wireless signal. Optionally, the receiver and transmitter are transceivers capable of bi-directional communication. For example, in an embodiment of the invention, bi-directional communication takes place between playhats and consoles or other physical components. For example, it could be desired that one playhat communicated to another playhat so that the second playhat responded uniquely to a signal from the first playhat. To achieve such bi-directional communications receivers and transmitters of the invention, as described herein, could be replaced by transceivers. Optionally, the liquid is water. Optionally, the headgear further comprises at least one dispenser configured to dispense the liquid from the liquid reservoir onto the player's head when the receiver receives the wireless signal from the transmitter. Optionally, the at least one dispenser comprises at least one tube comprising a proximal end connected to the liquid reservoir and a distal end and further wherein the at least one tube is configured to transport the liquid from the liquid reservoir so that the liquid may be dispensed onto the player's head. Optionally, the at least one dispenser comprises at least one tube and at least one spray nozzle and further wherein the at least one tube comprises a proximal end connected to the liquid reservoir and a distal end connected to the at least one spray nozzle and further wherein the at least one tube is configured to transport the liquid from the liquid reservoir to the at least one spray nozzle so that the at least one spray nozzle may dispense the liquid onto the player's head.

The present disclosure further provides a method of play comprising the steps of: a) providing the gameset; b) placing the headgear on a player's head; c) transmitting a wireless signal from the transmitter to the receiver; and d) dispensing liquid from the liquid reservoir onto the player's head in response to the receiver receiving the wireless signal from the transmitter. Optionally, the method further comprises at least one player playing a gameplay sequence before step c). Optionally, said transmitter is located on a handheld remote device further comprising at least one switch and the method further comprises at least one player directly or indirectly manipulating the at least one switch before step c). In other words, the transmitter may located on a handheld remote device further comprising circuitry and a button and the method may further comprise at least one player depressing or failing to depress a button, causing the circuitry to generate and emit the wireless signal.

Optionally, the remote device is a mobile phone and the at least one switch is an electronic switch activated by at least one player playing a game app on the mobile phone and depressing, for example, a certain location on the graphical user interphase of the mobile phone. Optionally, the transmitter is located on a remote device that further comprises at least one switch and the method further comprises at least one player directly or indirectly manipulating the at least one switch in accord with a programmed gaming sequence before step c). Optionally, the transmitter is located on an electronic tabletop game console that further comprises at least one switch and method further comprises directly or indirectly manipulating the at least one switch, prior to step c) to identify the position of the headgear relative to the electronic tabletop game console.

The present disclosure further provides a method of play of a game activity comprising the steps of: a) positioning at least one player near an electronic tabletop game console that comprises a liquid reservoir configured to hold a liquid, a dispenser configured to spray the liquid from the liquid reservoir onto the player, and at least one switch; b) activating the electronic tabletop game console; c) directly or indirectly manipulating the at least one switch in accord with a programmed gaming sequence; and d) the electronic tabletop game console spraying liquid from the liquid reservoir towards the at least one player in response to the manipulation of the at least one switch. Again, the electronic tabletop game console may include circuitry and the at least one player may manipulate components within the circuitry before step c) by, for example, depressing or failing to depress a button.

DETAILED DESCRIPTION OF THE DRAWINGS

With reference to FIGS. 1-11, the present disclosure generally provides a game for delivering water or other liquid onto a player's head. In some embodiments, the present disclosure provides a system that includes at least two components: 1) a transmitter unit, which may be in the form of a toy blaster gun or electronic tabletop game console for example, comprising a transmitter that transmits a wireless signal to a receiver unit; and 2) the receiver unit, which may be in the form of headgear, such as a playhat, worn by a second player for example, and includes a receiver for receiving the wireless signal. Then in response, water or another liquid is dispensed from a liquid container located on the headgear onto the second player's head. The toy blaster gun may include a handle and trigger for example. In other embodiments, the electronic tabletop game console itself directly sprays water or other liquid onto the player. These and additional embodiments are described below, together with additional optional features.

Figure 1:
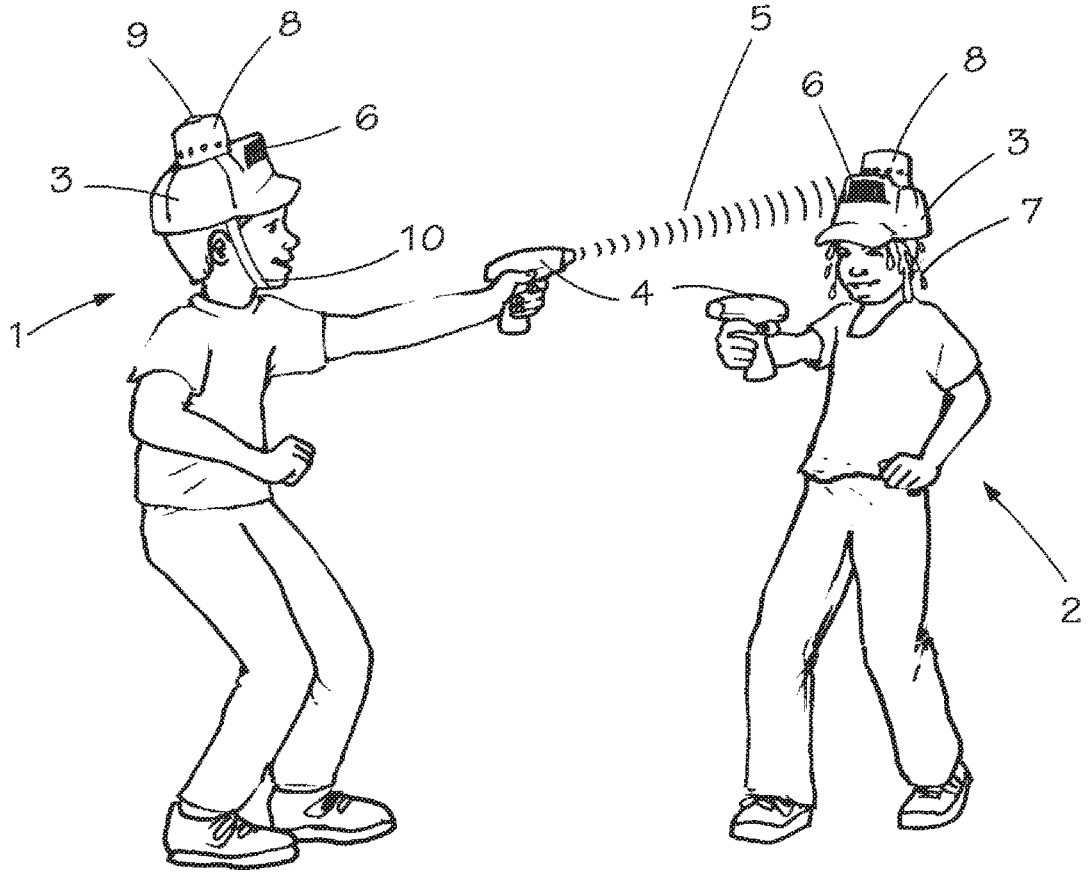
FIG. 1 illustrates a side perspective view of two players playing a gameset of one embodiment of the present invention, as a combative game competition with handheld blaster guns.

Referring now to FIG. 1, players 1 and 2 are depicted each holding a toy blaster gun 4 that includes a transmitter 100 for transmitting a wireless signal(s) such as an infrared signal, when a trigger 15 is depressed. Radiating lines 5 represent the infrared signal as it is traveling to electronic signal receiver 6 coupled to the headgear, namely, a playhat 3 that each player 1 and 2 is wearing. Preferably, playhats 3 are in the form of a helmet as illustrated in FIG. 1. Said playhats 3 each contain a liquid container 8 that can release liquid preferably water 7 onto the head of a player wearing the playhat 3. Playhats 3 can each have a liquid (preferably water) fill location hole that can be sealed by a removable or pivotable cap 9. The players 1 and 2 would stand at a distance from one another and partake in an action sport competition commonly referred to as "laser tag" where each player is attempting to score points by transmitting a signal to a remote receiver on an opponent's body-worn equipment, preferably their head. In the unique invention of this application, instead of simply sounds and scoring being activated, water is released onto the head of a player who is wearing a water-containing playhat 3 that responds to a wireless signal 5 transmitted by a transmitter 100 of a toy blaster gun 4 of another player. A playhat 3 could be held securely in place on a player's 1 and 2 head by a retainer strap 10. Other wireless signal technology could be employed instead of infrared, such as radio frequency signals or Near Field technology or light beams. Infrared is a preferred embodiment for this invention since the infrared beam is very easily directed in a particular direction (for example, by a molded shield or mask that would require the beam-transmission to be accurately directed by the player holding the blaster gun 4), thus reinforcing the play pattern of one player (for example, player 1) aiming their blaster gun 4 at player 2, while player 2 is attempting to avoid his or her receiver 6 from receiving the wireless signal 5. Directional control of the wireless signal is further detailed in the description of FIG. 2, below. Toy blaster gun further includes handle 101.

Figure 2:
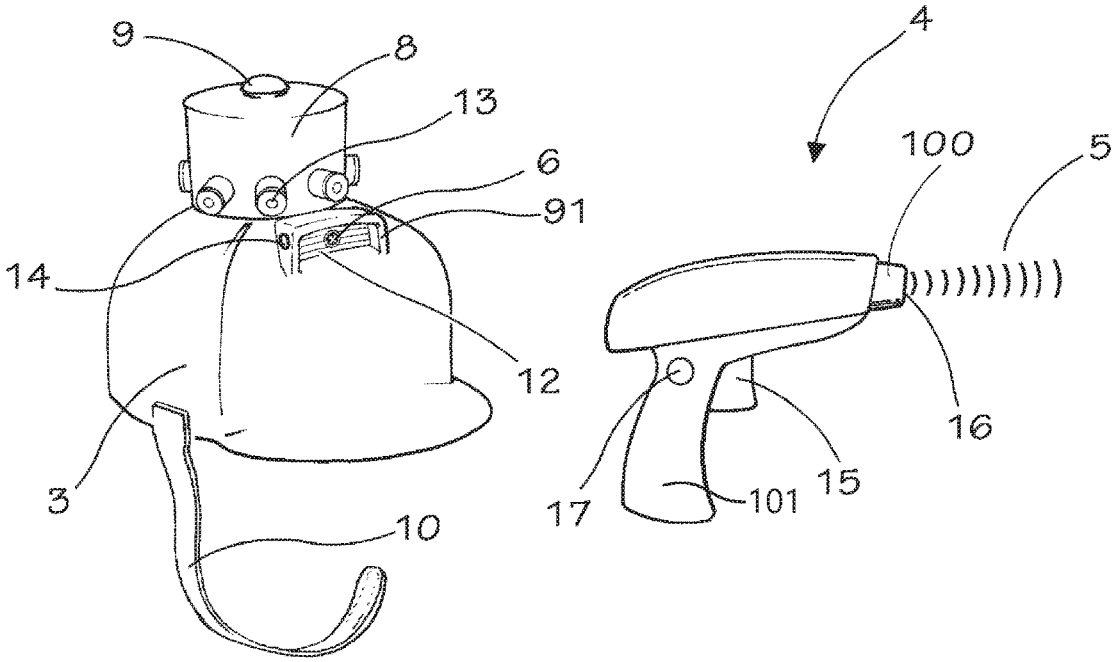
FIG. 2 illustrates side views of the playhat and blaster gun of the gameset of FIG. 1.
Figure 2A:
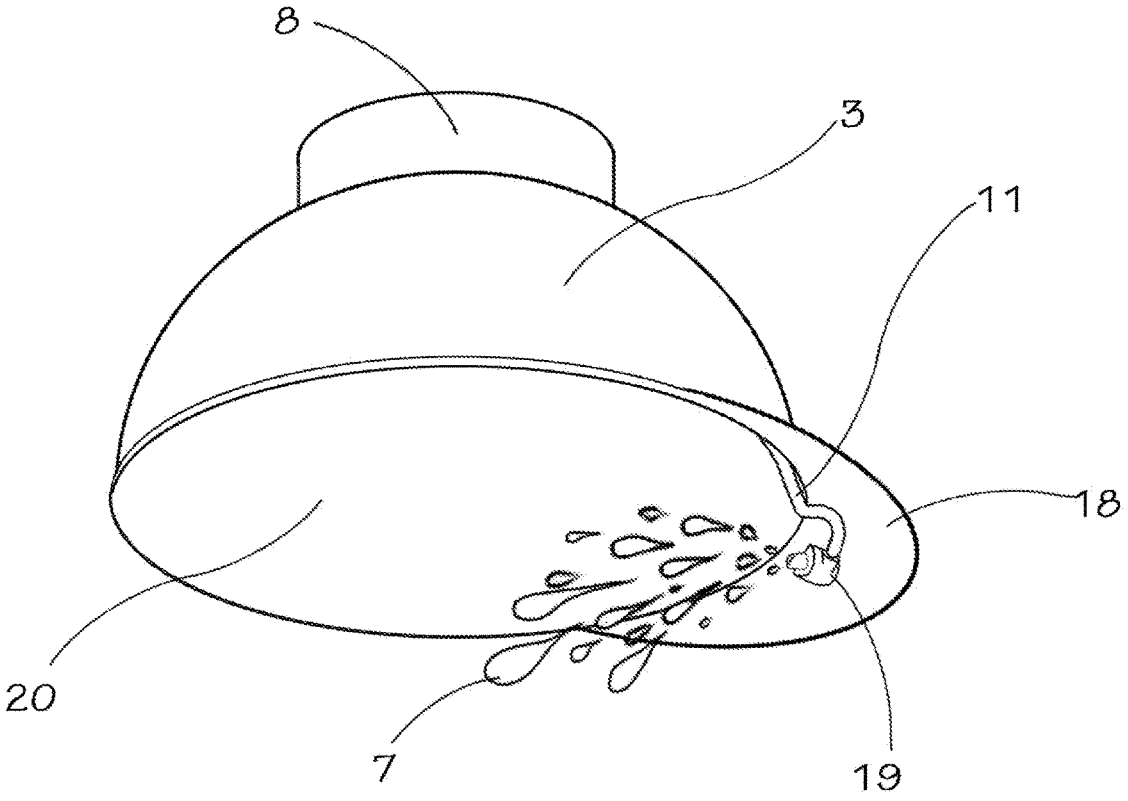
FIG. 2A, illustrates a bottom perspective view of the playhat of FIG. 2.

FIG. 2 illustrates the parts of the embodiment shown in FIG. 1. Playhat 3 can be manufactured of high impact styrene or similar moldable plastic material such as ABS or polyethylene or polypropylene. Retainer strap 10 could be vinyl or similar flexible material. Alternatively, an internal adjustable headband, not shown, could be positioned in the playhat 3 interior. Coupled to the playhat 3 is an electronic signal receiver 6 positioned in a visually unique "target area" 12 of said playhat 3, so that another player can see where to aim their toy blaster gun 4 during a play round. Sidewalls 91 at the target area of playhat 3 provide a certain measure of "aim-requirement" for wireless beam direction to provide for gaming challenge, requiring opponents to aim their blaster gun 4 accurately. Furthermore, the shape of the LED transmitter lens of the blaster gun 4 can be so shaped as to affect the beam shape as it exits the blaster gun 4. Infrared technology, the preferred wireless signal embodiment for the handheld blaster gun gameplay, can be specified as being infrared laser, or narrow-beam or wide-beam infrared (all commonly known to those skilled in the art) to further enhance gameplay aiming to activate water release. Playhat 3 includes a switch 14 (e.g., an on/off switch) to activate the internal electronics shown in FIG. 6. Players 1 and 2 fill the liquid container 8 on each playhat 3 with water by pouring water into a hole underneath the removable cap 9. Players 1 and 2 activate the electronics in their playhat 3 by pressing the ON switch 14. Sounds could be emitted to signal that the playhat 3 circuitry was ready for play. LED lights 13 could illuminate and then stay lit or else blink during play rounds, or when a playhat 3 received a wireless signal 5 from an opponent's blaster gun 4. Each blaster gun 4 could be molded from injection molded high impact styrene plastic, or equivalent material commonly used to manufacture toys, such as ABS. Blaster guns 4 are depicted with a movable trigger 15 that when depressed activated the blaster gun transmitter 100 to transmit a wireless signal beam 5 from the front tip 16 of said blaster gun 4. Blaster gun electronic circuitry 40, illustrated in greater detail in FIG. 7, is activated by a player pressing a blaster gun ON switch 17. FIG. 2A shows a bottom perspective view of the playhat 3. Water container 8 is situated on top of the playhat 3. A water tube 11 has a proximal end connected to the water container 8 and a distal end connected to at least one spray nozzle 19 which in this embodiment is coupled to the underside of the hat brim 18 and therefore pointed towards the forehead of the players 1 and 2 wearing the playhats 3. It is understood there can be more than just one spray nozzle 19, and that said spray nozzle(s) 19 could be positioned any place inside the hat cavity 20, which also includes the player's head when the playhat 3 is worn. Alternatively, instead of a spray nozzle 19 (more clearly illustrated in FIG. 9), the delivery of released water 7 could be accomplished by the opening of a mechanical valve assembly 21 (FIG. 9A) to simply allow the water 7 to flow down from the water container 8 onto the head of the player 1 wearing the playhat 3, eliminating the requirement for any motorized pumping action. In an embodiment, water is not pumped from the liquid container 8 by a motorized pump but instead falls by gravity for example, though the mechanical valve assembly 21 may be powered. Preferably, however, a pump 47 is utilized to pump water from the liquid container 8.

Figure 3:
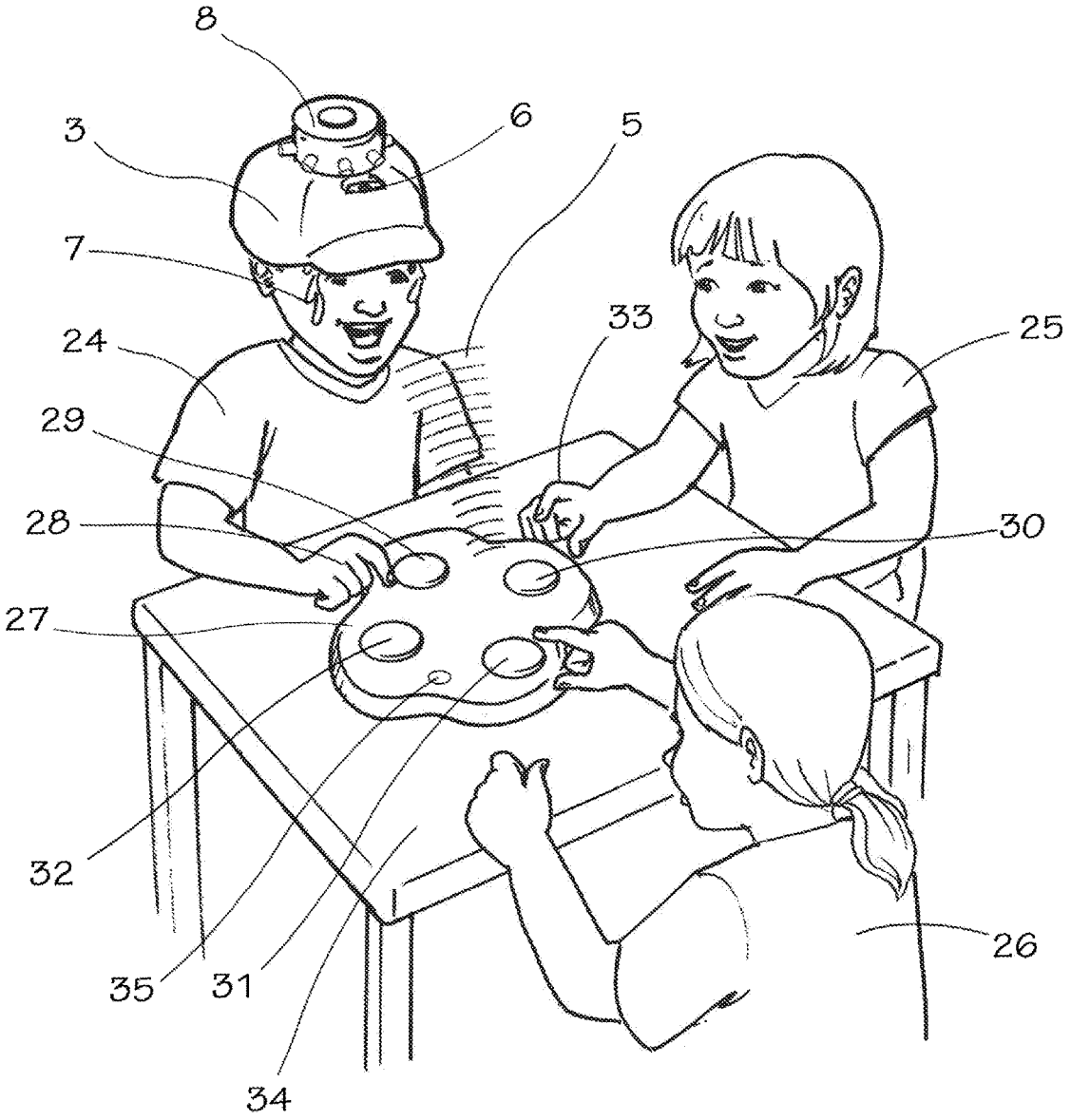
FIG. 3 illustrates a top perspective view of three players playing an electronic tabletop gaming console of one embodiment of the present invention, with one player wearing a playhat.

FIG. 3 illustrates an alternative gaming activity for the invention, in which the playhat 3 is worn by only one player 24, 25 or 26 of the game. All players, as illustrated by three players 24, 25, and 26, are seated at a game table 34. Players' hands 28 and 33 are depicted as being positioned above their respective play buttons 29, 30, 31, and 32. Electronic tabletop game console 27 is positioned on game table 34. (Electronic tabletop game console 27 is described in greater detail in FIG. 11). Play buttons 29, 30, 31, and 32 are situated atop the electronic tabletop game console 27. Players 24, 25, and 26 play a game as programmed into said electronic tabletop game console 27, and can, for example, be required to press a play button or buttons 29, 30, 31, and 32 in response to game rules and programming in the electronic circuitry of said console 27. When a specific play pattern is achieved (for example the wearer 24 of the playhat 3 failing to complete a light sequence by failing to press his play button 29 at the proper time) a wireless signal 5 can be emitted from the game console 27 to be received by the electronic signal receiver 6 in the playhat 3, activating the release of water 7 onto the head of the seated player 24. Exemplary gameplay could be as follows, it being understood that some of the order of events might vary:

A. The electronic tabletop game console 27 is activated by system button 35;

B. The water container 8 of playhat 3 is filled with water;

C. The playhat 3 is turned on via a switch 14, at which time LED's 13 can illuminate;

D. Players 24, 25, and 26 are seated at a table 34 and can press their respective buttons 24, 25, and 26, one at a time, to inform the circuitry 61 (see FIG. 8) how many players are playing, and also inform the circuitry 61 which player 24, 25, or 26 is wearing the playhat 3 (since the penalty of water release is contingent upon who is wearing the playhat 3 when a round is terminated). Informing the electronic tabletop game console circuitry 61 as to which player 24, 25, or 26 is wearing the playhat 3, can for example be accomplished in this manner: players can be instructed that the one player wearing the playhat 3 must press their electronic tabletop console game button 29 first;

E. Players 24, 25, and 26 select a particular gameplay (perhaps by pressing system button 35 several times) and then proceed to play the selected game by one or each player pressing play buttons 29, 30, and 31, respectively, on the electronic tabletop game console 27 in response to specific game rules (such as repeat a light sequence, or repeat a light sequence and add one);

F. A play event is completed (for example all players successfully complete a play button pressing sequence; OR the player 24 wearing the playhat 3 failing to press his play button 29 in time);

G. A wireless signal 5 is transmitted to a compatible wireless receiver 6 located on the playhat 3;

H. Water 7 is released onto the head of the player 24 wearing the playhat 3;

I. The play round concludes and the playhat 3 is passed to another player 25 or 26 at the table 34, for example to the player 25 to the left of the player 24 that just got wet.

Alternatively, a similar gameplay scenario can be played by all players and in the event one player who is not wearing the playhat 3 interrupts a button pressing sequence by failing to press their play button 29, 30 or 31 in time; then their respective console light (for example a light on button 31 for player 26) would blink, the round would end, and the player who had been wearing the playhat 3 for the just-concluded play round would remove the playhat 3 from their head and pass it to player 26, who would then put on the playhat 3 and wear it for the next play round. It can be understood that the electronic tabletop game console 27 as disclosed herein this application could be replaced by a mobile phone (i.e., a smartphone or tablet) that provides a game app and then emits a wireless signal 5 compatible and communicable with the receiver 6 in the head-worn playhat 3. The word "mobile phone" as used herein includes smart phones and tablets. For example, a playhat 3 as earlier described could be wirelessly connected to a Wi-Fi signal and then a game app, played on one or more smartphones, could coordinate to send Wi-Fi signals to a playhat 3 or playhats 3 to activate the release or spray of water 7 on a player or players 24, 25 or 26. Two or more players could compete on the same tablet or smartphone, or on separate tablets or smartphones. The first player to complete a gaming challenge sequence could transmit a wireless signal 5 that would then activate the release of water 7 onto the head of their opponent. In a more costly embodiment, a playhat 3 of the invention could be equipped to directly receive a wireless signal 5 from a smartphone or tablet, either from a smartphone or tablet already equipped to transmit infrared or radio frequency or Bluetooth signals, or via a connectable dongle device attached to said smartphone or tablet that then transmitted the necessary signal compatible to the signal convention of the playhat receiver 6. Such technology is typically understood by those skilled in the art of toy gaming electronics.

Figure 4:
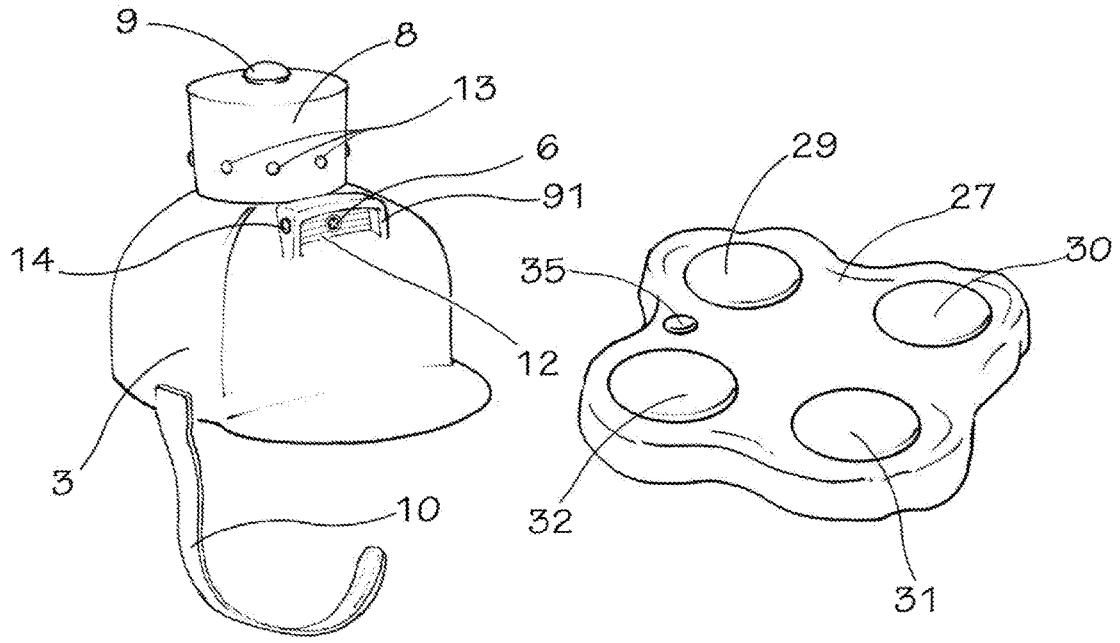
FIG. 4 illustrates side perspective views of the playhat and electronic tabletop gaming console of FIG. 3.
Figure 4A:
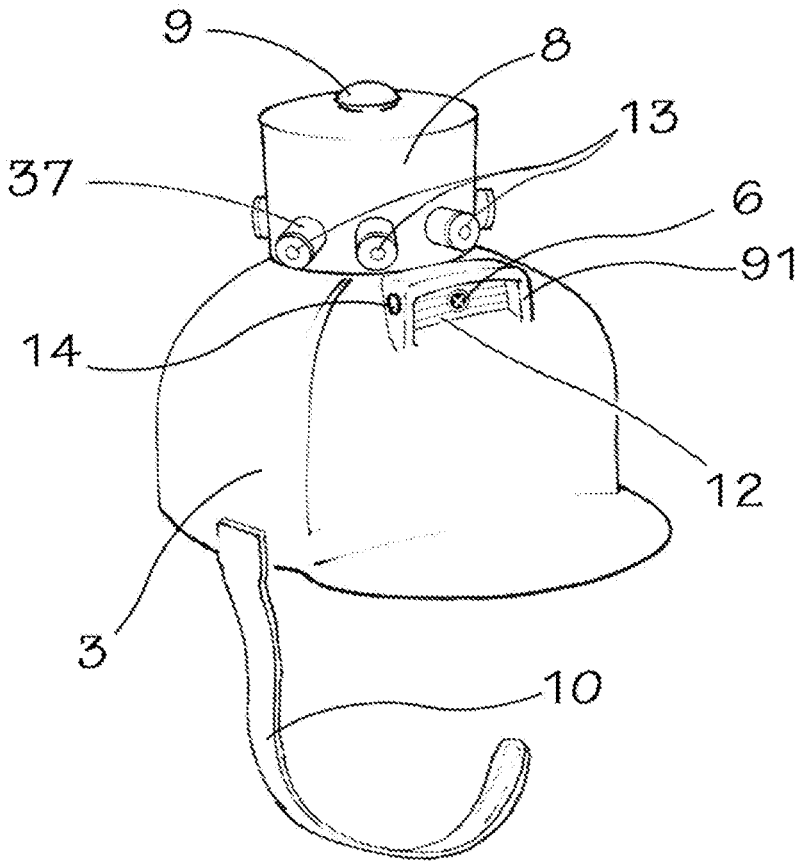
FIG. 4A illustrates a side perspective view of the playhat of FIG. 4.

FIG. 4 shows the playhat 3 and electronic tabletop game console 27 in greater detail. Elements of the playhat 3 and electronic tabletop game console 27 are as earlier described. A system button 35 on electronic tabletop game console 27 can be depressed to turn the electronic tabletop game console 27 to an "ON" state or to reset the electronics within the electronic tabletop game console 27 for a new game session, or to select one of several pre-programmed gameplays. Button 14 activates the circuitry 40 inside the playhat 3. Electronic signal receiver 6 is visible in an area of the playhat 3 that can be molded for targeting by a gaming opponent. LED's 13 can be located on the playhat 3, preferably at the lower region of the water container 8. Said LED's 13 can illuminate and blink or flash to signal an ON state and also to signal when a water release event occurs. FIG. 4A illustrates the LED's 13 being located at the tips of molded plastic rods 37, to simulate the iconic design of the classic toy "WETHEAD", the invention described herein is intended to be a technical advancement and improvement over said classic and successful toy. Rods 37 need not be removable for any reason and could in fact be molded integral to said water container 8. It is obvious that the shape of water container 8 can vary and need not be a cylinder.

Figure 5:
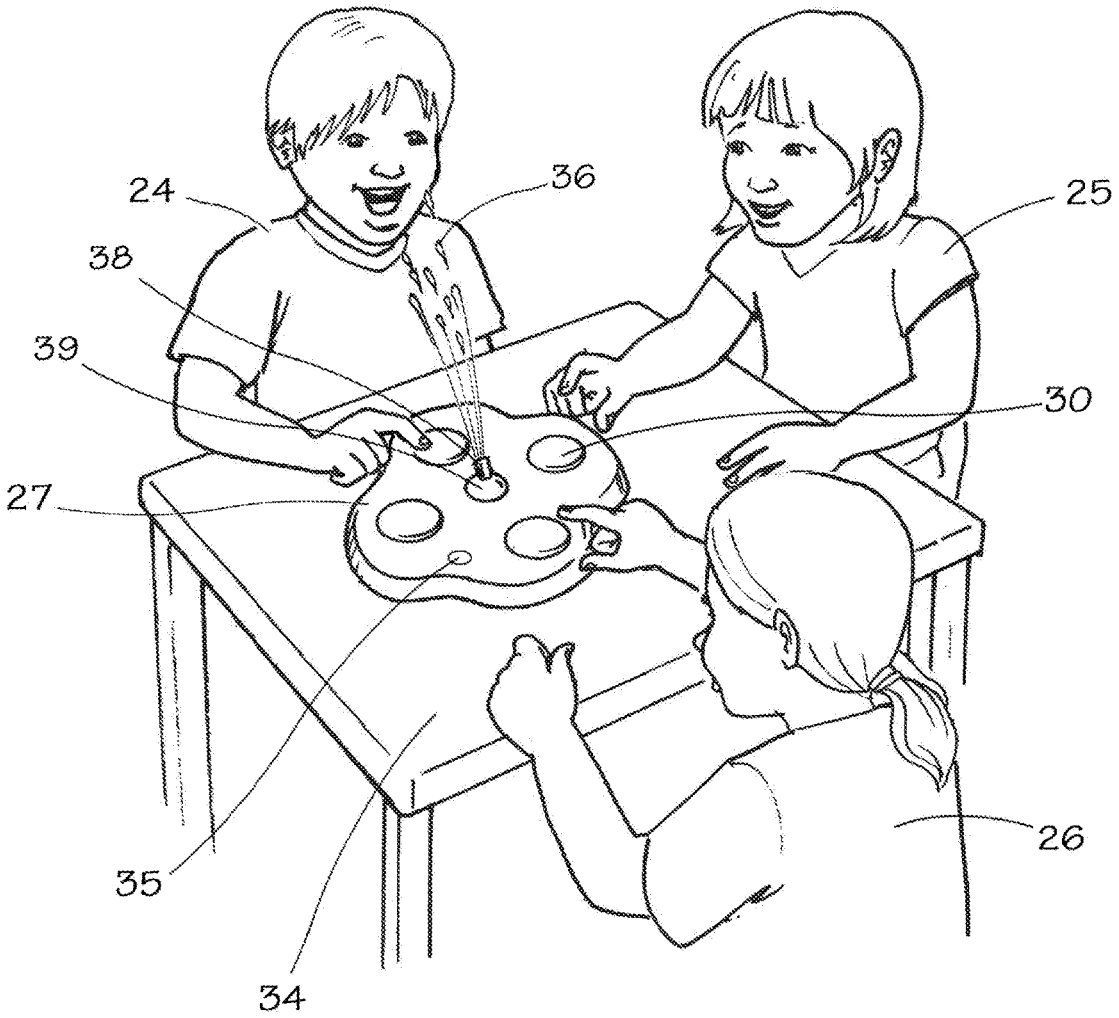
FIG. 5 illustrates a top perspective view of three players playing an electronic tabletop gaming console of another embodiment of the present invention; the embodiment of FIG. 5 does not include a playhat.

FIG. 5 illustrates a slight modification to the play pattern of the invention, in that the spray event at the conclusion of a gameplay round does not involve water 7 being released from a playhat 3, but instead has water spray 36 being sprayed at a player (in this illustration, player 24) directly from the electronic tabletop game console 27. The water container (not shown) would be inside the electronic tabletop game console 27. Prior to the beginning of a game round, a movable nozzle 38 could be pointed towards one particular player (in this example, player 24) by means of a pivotable turret 39. Alternatively, the water 7 could be directed to spray onto all players, so that gameplay would be modified to require cooperation between players so no one lost a round, to avoid all players getting sprayed. The play activity would best be played on a table 34 as earlier mentioned.

Figure 6:
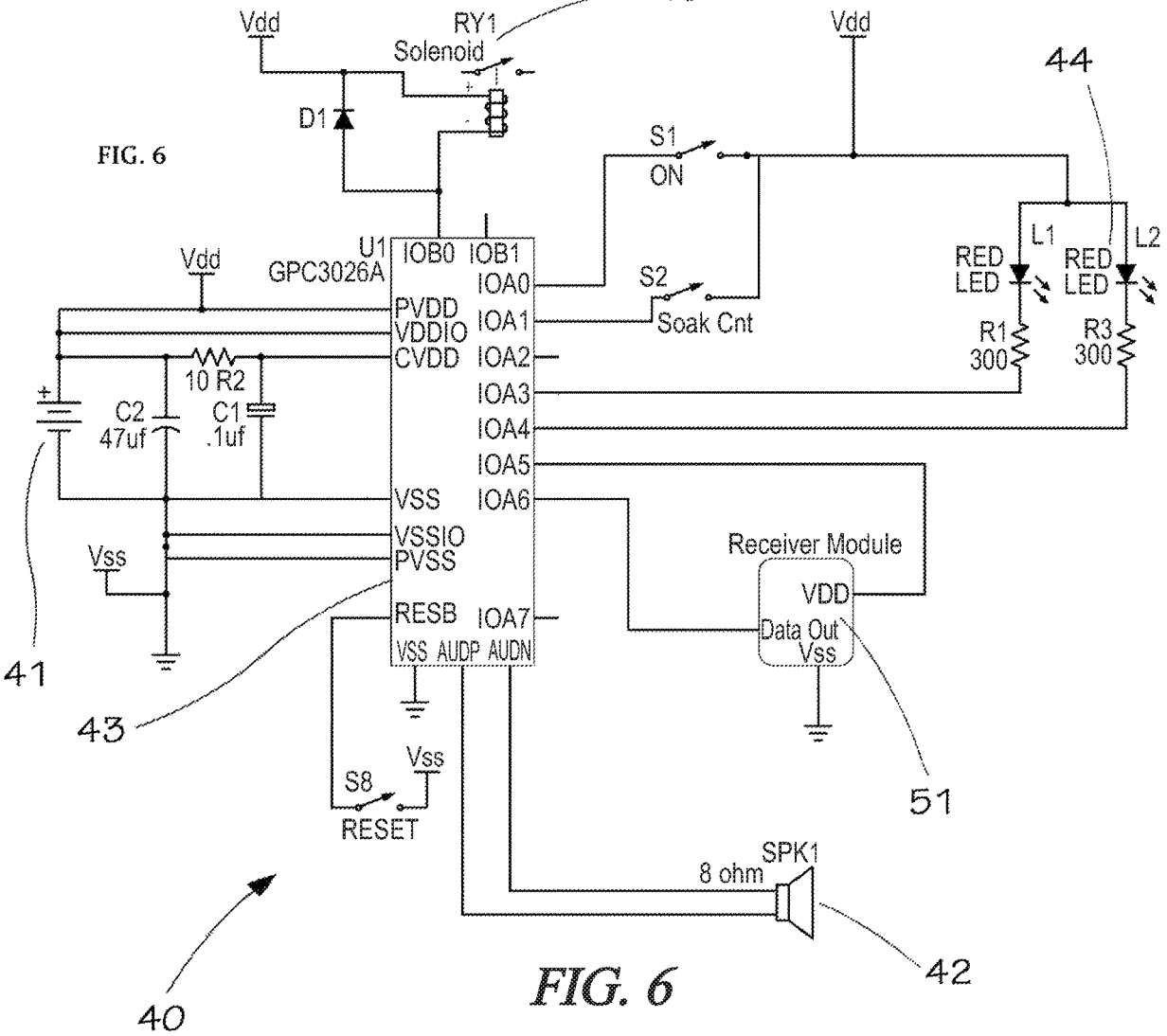
FIG. 6 is an exemplary schematic of the electronics of the playhat depicted in FIG. 1 and FIG. 2.
Figure 7:
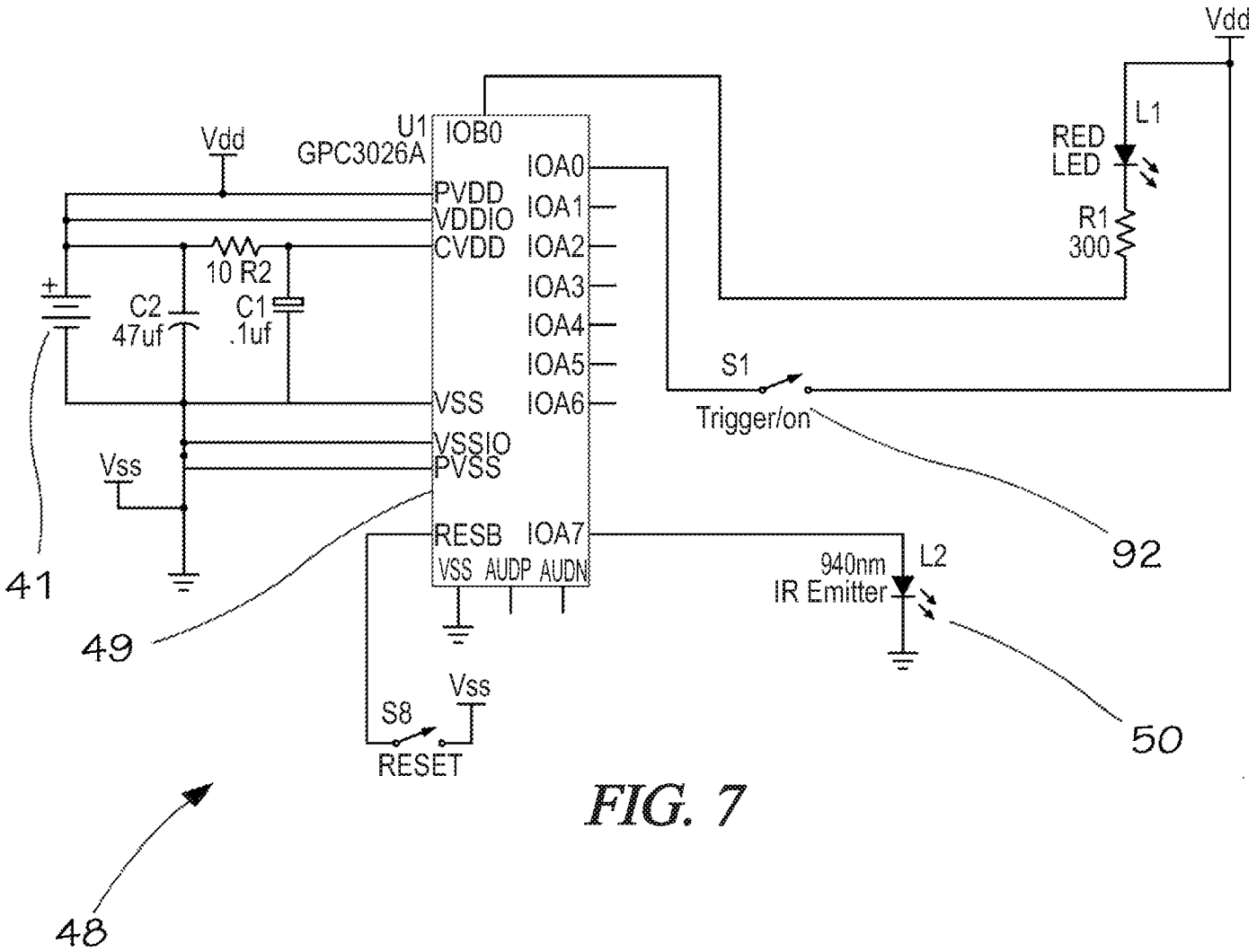
FIG. 7 is an exemplary schematic of an electronic circuit of the blaster gun depicted in FIG. 1 and FIG. 2.

FIG. 6 illustrates an exemplary schematic of the electronic circuitry 40 for the playhat 3, understandable by anyone familiar with the art of simple toy electronics. A battery or batteries 41 provides power for the circuitry 40. Said battery or batteries 41 could for example, be alkaline or nickel metal hydride, disposable or rechargeable. Lithium batteries could be utilized. Battery technology is commonly known for simple electronic toys. Voltage could preferably be 1.5 to 9 volts, direct current. These battery characteristics are representative of additional battery power sources mentioned in this patent application. Said circuitry 40 is intended to receive a wireless signal 5 (FIG. 1) when said wireless signal 5 is transmitted from a toy blaster gun 4 (FIG. 1) and received by a receiver labelled 51 in FIG. 6, initiating a series of programmed events in said playhat 3. Preferably the wireless technology utilized by the components of this invention would be infrared signal transmission and reception, as said technology is able to be directionally controlled. A speaker 42 could be provided to generate sounds when the circuitry 40 was turned on, activated during a gameplay sequence, or shut off. A circuit board 43 can be programmed to control and provide for gameplay logic, timing, and water release commands, as well as LED light 44 illumination. A solenoid controller 45 could send a signal to solenoid 82 to release water 7 from the water container 8 (FIG. 1) by moving a valve 85 (FIG. 9A). Alternative to a solenoid, a toy motor 46 (FIG. 9), for example a Mabuchi RE-280RA 6-volt DC motor 46 (FIG. 9) could be employed and activated by said circuitry 40 to activate a valve or pump 47 to release or pump water 7 onto a player's head.

FIG. 7 illustrates an exemplary schematic of the electronic circuitry 48 for the toy blaster gun 4, understandable by anyone familiar with the art of basic toy electronics. The circuitry 48 is intended to emit a wireless signal beam 5 (FIG. 1) when a player holding said toy blaster gun 4 moves trigger 15. Battery source 41 powers said circuitry 48. Circuit board 49 can be programmed to provide for wireless signal transmission when a user moves a trigger 15 (FIG. 1) activating a circuitry trigger switch 92 on said circuitry 48. A beam transmitter 50 can emit a wireless signal 5 that could be directed to the beam receiver 51 (FIG. 6). Although preferably the wireless technology utilized by the components of this embodiment of the invention would be infrared signal transmission and reception, as said technology is able to be directionally controlled, in the event radio frequency signaling is substituted, beam transmitter 50 and beam receiver 51 would, in that embodiment, be compatible with radio frequency technology.

Figure 8:
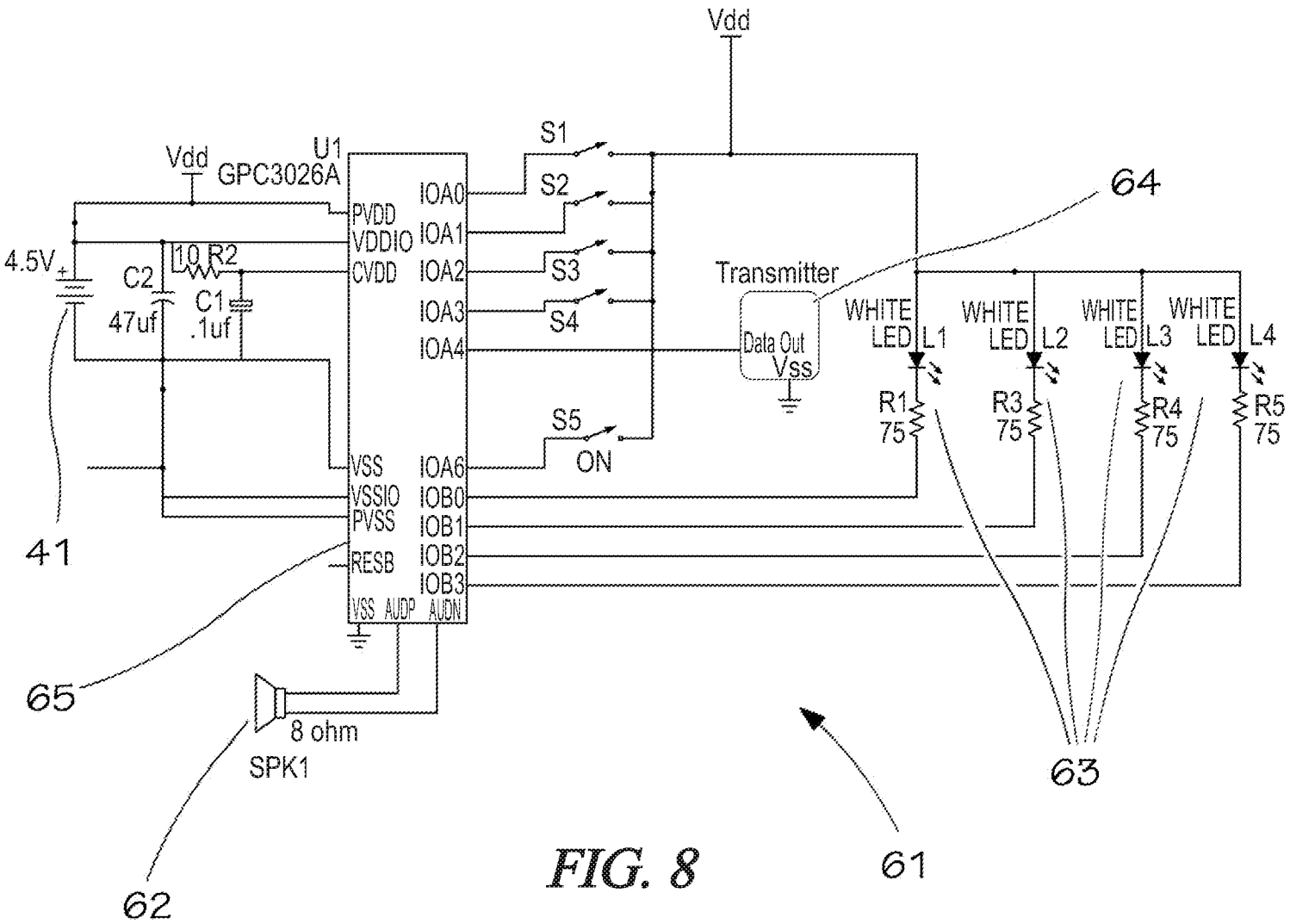
FIG. 8 is an exemplary schematic of an electronic circuit of the electronic tabletop game console depicted in FIG. 3 and FIG. 4.

FIG. 8 illustrates an exemplary schematic of the electronic circuitry 61 for the electronic tabletop game console 27, understandable by anyone familiar with the art of basic toy electronics. The electronic circuitry 61 is intended to provide gameplay activity for one to four players, requiring players to activate switches or buttons 29-32 (FIG. 3) in conjunction with game rules. For example, the programming of said electronic tabletop game console 27 could require that each player must touch-activate their respective button 29-32 within a designated time period after it has been illuminated by the circuitry 61. For example, one player of the game could be wearing the playhat 3 (FIG. 3). In this embodiment of the invention radio frequency ("RF") or Near-Field technology or Bluetooth technology, for signal transmission by console transmitter 64 might be preferred over infrared technology, since the location of the compatible receiver 6 inside the playhat 3 would vary in location as the playhat 3 might be transferred from one seated player to another seated player, in accordance with gameplay rules. For example, a player who failed to touch-activate his console button 29, 30, 31, or 32 but was not wearing playhat 3 when he failed, might then be required to wear the playhat 3 for the next round of play. In the event any player who happens to be wearing playhat 3 fails to touch-activate his button within the required time, then the circuitry 61 could generate and emit a wireless signal, represented by signal beam 5 (FIG. 3). Said signal beam 5 would be received by the receiver 6 and water 7 would release, as earlier described. The circuitry 61 could be comprised of a power source such as batteries 41, speaker 62 to emit unique sounds for each play button (29-32) and also special sounds when a spray-signal transmission event occurred. Console LED lights 63 could illuminate the buttons 29-32 (FIG. 3). In any embodiment of the invention, when one particular wireless signal technology such as infrared or radio frequency or Near Field technology was utilized in a transmitter 100, it would be understood that the receiver 6 (for example, in the helmet 3) would be of compatible technology so that wireless communication 5 was effectuated. Console circuit board 65 controls the gameplay and provides for players to select games to play and to press their buttons 29-32 at the outset of a gameplay session to designate how many players might be playing, etc. An exemplary gameplay might be preparing the playhat 3 for play by filling it with water 7 and turning on its circuitry 40 (as described earlier in FIG. 2 description). In accordance with programmed gameplay and player or players input, console transmitter 64 or gun transmitter 100 eventually sends signal to a remote receiver 6, to activate water 7 release.

Figure 9:
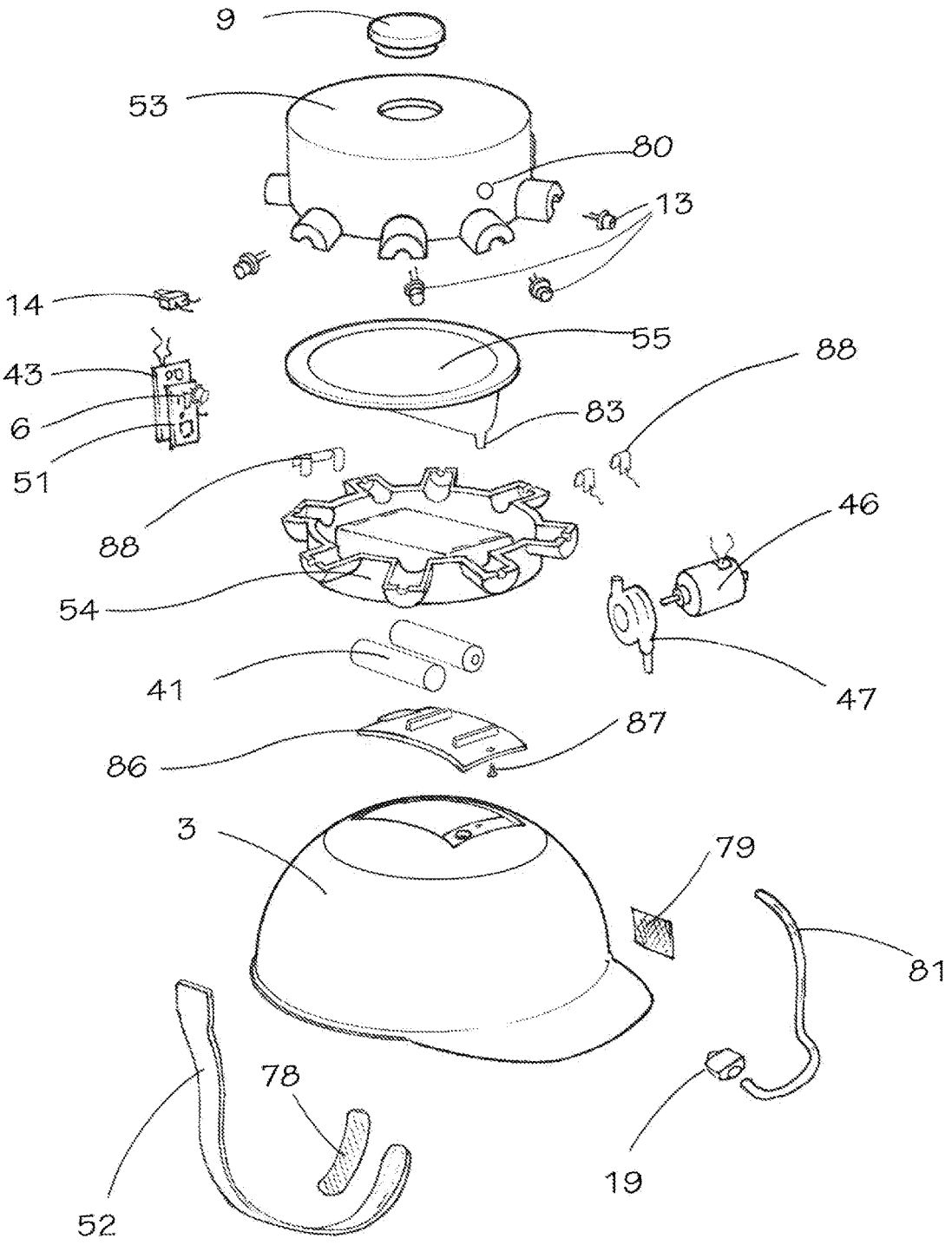
FIG. 9 is a side exploded view of the playhat depicted in FIG. 1 and FIG. 2.
Figure 9A:
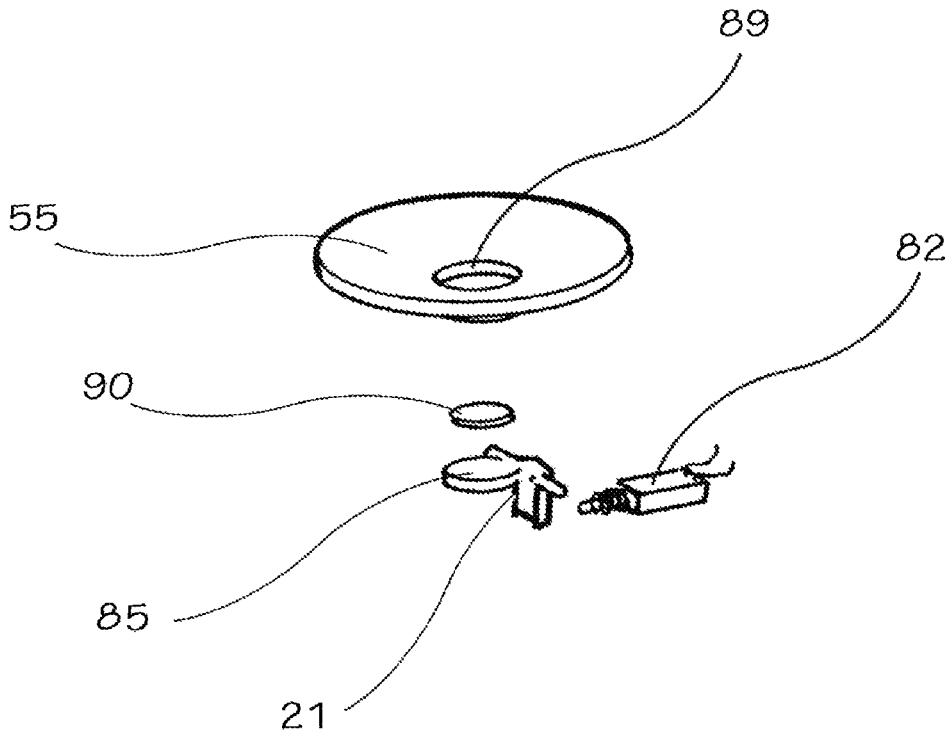
FIG. 9A is a side exploded view of components of the playhat depicted in FIG. 1 and FIG. 2.

FIG. 9 illustrates an exploded view of the playhat 3. Strap 52 can secure said playhat 3 onto a player's head, by securing around their chin via hook and loop fastener material 78 and 79, or a snap or buckle. Alternatively an adjustable flexibly molded inner sizing ring (not shown) could be installed into the playhat 3 and then adjusted for head size fit. Container 8 (FIG. 1) may be generally comprised of top section 53 to hold water 7 and bottom section 54. Bottom section 54 would not contain water 7 in this embodiment but instead could be isolated from the water area by a reservoir bottom 55. Within bottom section 54 could be the electronic and electro-mechanical components of the playhat 3, such as batteries 41, LED's 13, an ON/OFF switch circuit board 43, signal receiver circuit board 51, etc. Coupled to said ON/OFF switch circuit board 43 may be ON/OFF switch 14 that is accessible by the wearer from the outer surface of the playhat 3, and also wireless beam receiver 6, which is controlled by receiver module 51, which could receive a wireless signal 5 from a remote wireless signal transmitter 100 as earlier described. In the event the wireless signal transmission was infrared and required line-of-sight, access portal 80 could be so molded as to directionally provide desired line of sight signal transmission receipt. When the ON/OFF switch circuit board 43 is activated, (in a preferred embodiment) a small motor 46 could activate to activate a pump 47 that would draw water 7 (not shown) from the top reservoir housing 53 and then spray that water 7 through a tube 81 and a spray tip nozzle 19, onto the wearer of the playhat 3. Proximal end of tube 81 could be coupled to the bottom of reservoir bottom outlet 83. Distal end of tube 81 may be attached to the underside of hat brim 18. Batteries 41, battery door 86, battery door screw 87, and contacts 88 are all commonly understood parts and not described in detail. FIG. 9 illustrates an alternative position, on playhat 3, for wireless signal reception, depicting wireless signal beam portal 80 and signal receiver 6 as being situated on the water container 8, as opposed to being situated on the main playhat front area, as shown in FIG. 2.

An alternative means to deliver water 7 onto a wearer of the playhat 3 could be provided by replacing the motor 46 with a solenoid 82, shown in FIG. 9A, although it should be understood that a motor and a solenoid could generally be interchanged in both FIG. 9 and FIG. 9A embodiments, and in fact are often substituted one for another in many toy applications where a small amount of energy is desired for simple parts activation. FIG. 9A further describes the substitution of a pivoting valve plate 85 that is moved to an open position by solenoid 82 to allow gravity flow of the water 7 through hole 89 at the bottom of reservoir bottom 55. If necessary, a flexible seal 90 could be installed to prevent water from leaking when pivoting valve plate 85 was in its closed position. Pivoting valve assembly 21 can be pivotably attached to molded bosses or detents in said playhat inner structure. In the embodiment wherein it is desired for water to be actively pumped out onto the user's head, a motor 46 might be more desirable than a solenoid 82. Battery compartment lid 86 is intended to allow safe access to the batteries 41 for installation and replacement. In the event rechargeable batteries 41 were to be employed, recharging could be via a recharger port, not shown but commonly understood. It is also commonly understood that batteries 41 require contacts to complete their connection to the components utilizing their power, and therefore not illustrated.

Figure 10:
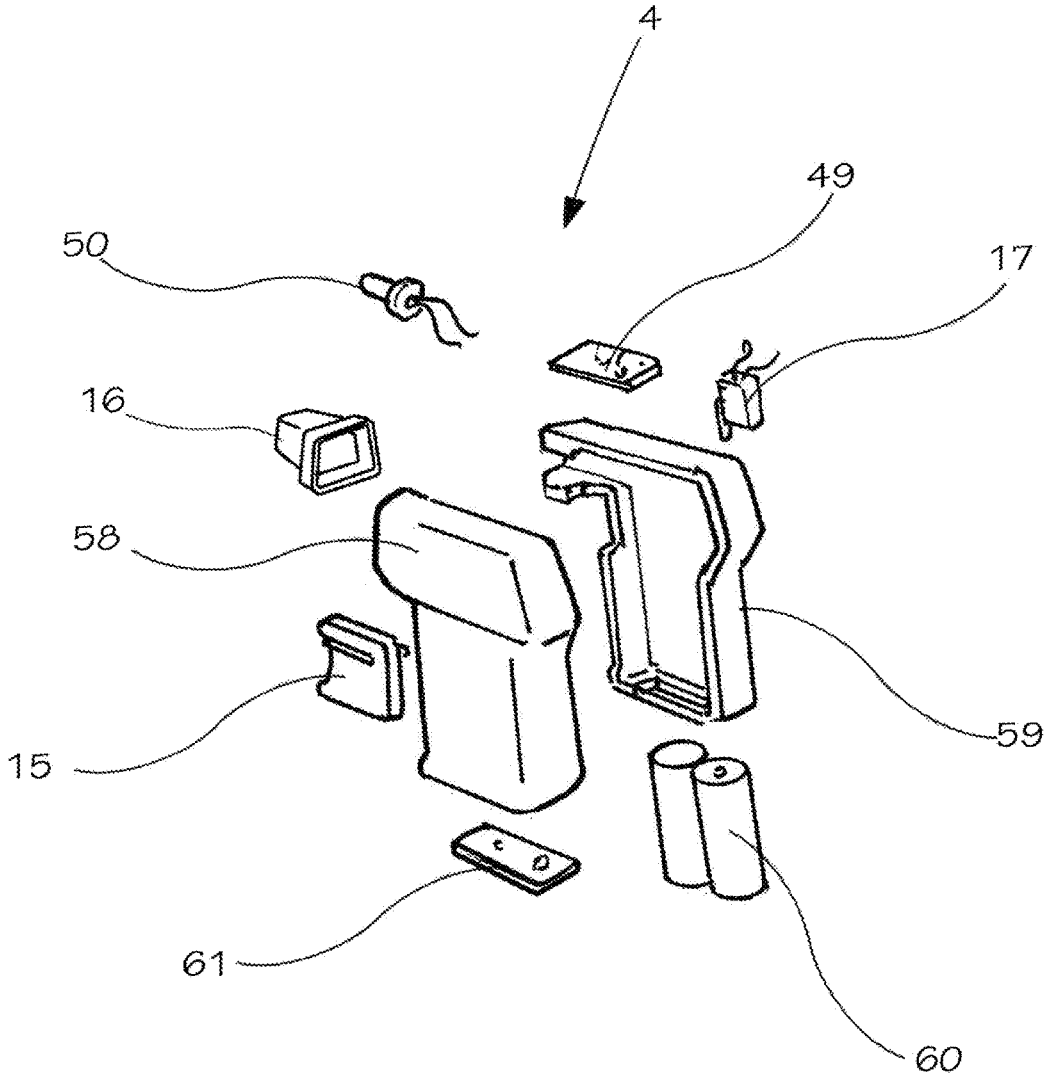
FIG. 10 is a side exploded view of the blaster gun depicted in FIG. 1 and FIG. 2

FIG. 10 illustrates an exploded parts view of the toy blaster gun 4 as shown in FIG. 1 and elsewhere. Said blaster gun 4 can include two housing halves, 58 and 59. Said halves 58 and 59 can be coupled together via solvent bond or screws, or one-time snap-together detents, to create the complete blaster gun 4. Inside said blaster gun 4 may be circuit board 49 and batteries 60. Coupled to said circuit board 49 and accessible from the outside of said housing halves 58 and 59 may be a movable trigger 15 that is configured to control signal beam 5 transmission, a master ON switch 17 that would power said circuit board 49 on or off, and an open front tip section 16 to allow wireless beam egress for signal beam 5 (FIG. 1) transmission towards the electronic signal receiver 6 in playhat 3 (FIG. 1). Battery door 61 could be removable to allow safe access to batteries 60, which may be coupled to and provide power to circuit board 49.

Figure 11:
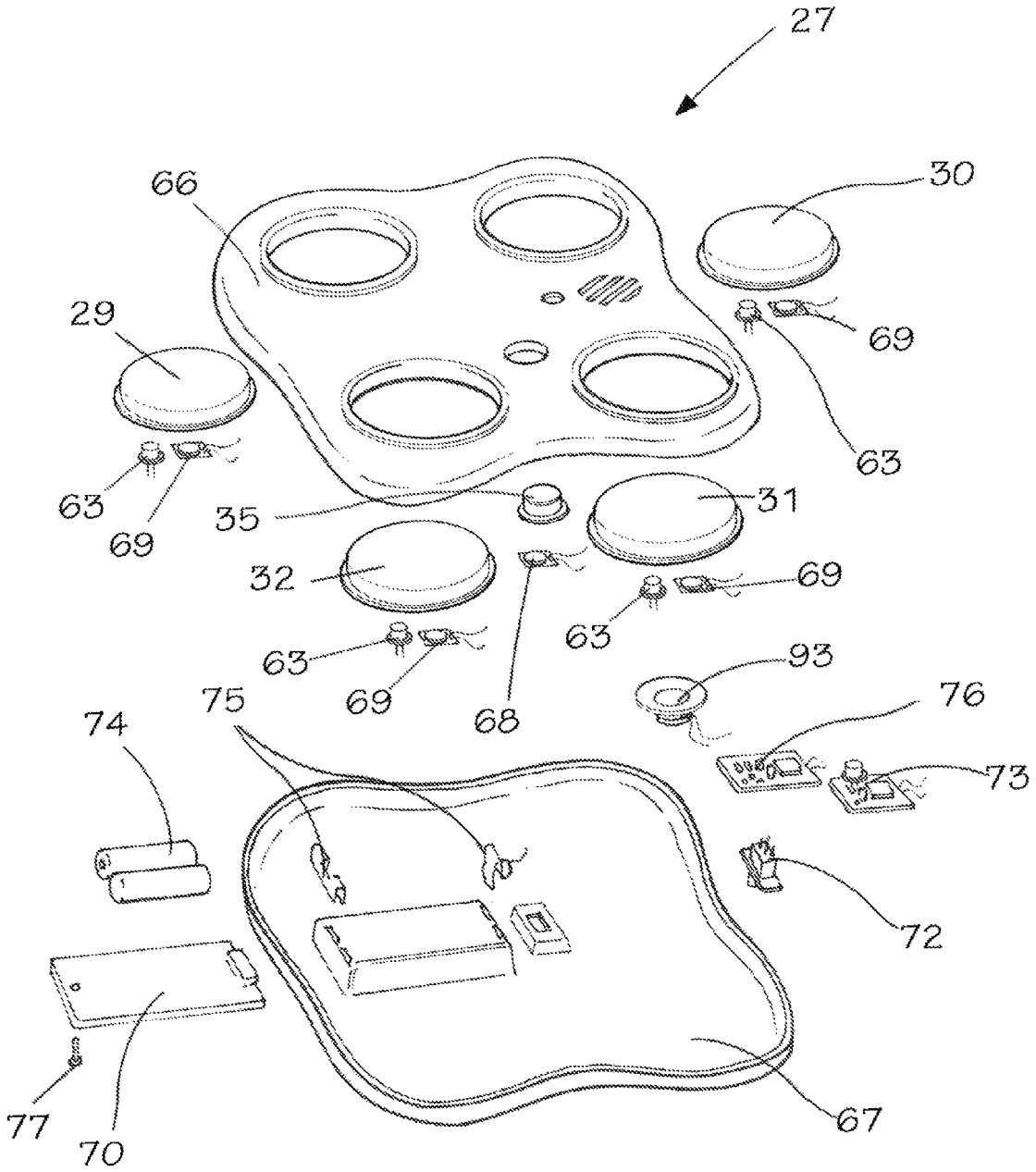
FIG. 11 is a side exploded view of the electronic tabletop gaming console depicted in FIG. 4.

FIG. 11 is an exemplary parts breakdown of an electronic tabletop game console 27. Game console housing top 66 and housing bottom 67 could be molded of plastic and could be solvent bonded or screwed together. Electronic tabletop game console 27 could include play buttons 29, 30, 31 and 32 that can be depressed by a player or players to activate their respective switches or micro switches 69. System button 35 could be activated by the players to select a particular gameplay, and to begin the play of a play round, by activating micro switch 68. A master ON/OFF switch 72 could be positioned elsewhere on the electronic tabletop game console 27. Battery door 70 may be retained in position by screw 77 and then removed to access or replace or recharge batteries 74. Wireless signal transmitter board 73 and circuit board 76 may be contained inside electronic tabletop game console 27. Battery contacts 75 are also illustrated. Console speaker 93 can emit unique sounds corresponding to play sequences, correct or incorrect input by players, timing actions, and/or wireless signal transmission (when water-release signal 5 has been transmitted).

The power source for the toy blaster gun 4, electronic tabletop game console 27, and playhat 3 is preferably batteries, however, these components, particularly, electronic tabletop game console 27 could be powered by a wall outlet.

Optionally, the receiver 5 and/or transmitter 100 described herein are transceivers capable of bi-directional communication. For example, in an embodiment of the invention, bi-directional communication takes place between playhats 3 and electronic tabletop game consoles 27 or other physical components. For example, it could be desired that one playhat 3 communicated to another playhat 3 so that the second playhat 3 responded uniquely to a signal from the first playhat 3. To achieve such bi-directional communications receivers 5 and transmitters 100 of the invention, as described herein, could be replaced by transceivers. Thus, the word "receiver" as used herein encompasses both receivers and transceivers. Likewise, "transmitter" as used herein encompasses both transmitters and transceivers.

In some embodiments, the user indirectly or directly manipulates a "switch." The user may so manipulate the switch by activating the circuitry 40, 48, and 61, or components therein. For example, a user could depress, or fail to depress, a button 29-32, which in turn activates a switch within the electronic tabletop game console circuitry 61, causing the electronic tabletop game console circuitry 61 to generate and emit a wireless signal 5. Alternatively, a switch within playhat 3 could activate the playhat circuitry 40 and cause motor 46 to activate a valve or pump 47 to release or pump water 7 onto a player's head.

Having now described the invention in accordance with the requirements of the patent statutes, those skilled in the art will understand how to make changes and modifications to the disclosed embodiments to meet their specific requirements or conditions. Changes and modifications may be made without departing from the scope and spirit of the invention. In addition, the steps of any method described herein may be performed in any suitable order and steps may be performed simultaneously if needed.

Terms of degree such as "generally", "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

| Part Number | Part |
|---|---|
| 1 | player one |
| 2 | player two |
| 3 | playhat |
| 4 | toy blaster gun |
| 5 | signal beam |
| 6 | electronic signal receiver |
| 7 | water (released) |
| 8 | container |
| 9 | removable cap |
| 10 | retainer strap |
| 11 | water tube |
| 12 | target area |
| 13 | LED |
| 14 | playhat ON switch |
| 15 | trigger |
| 16 | front tip |
| 17 | blaster gun ON switch |
| 18 | hat brim |
| 19 | nozzle |
| 20 | hat cavity |
| 21 | mechanical valve assembly |
| 24 | seated player 01 |
| 25 | seated player 02 |
| 26 | seated player 03 |
| 27 | console |
| 28 | seated player 01 hand |
| 29 | player 01 console button |
| 30 | player 02 console button |
| 31 | player 03 console button |
| 32 | player 04 console button |
| 33 | seated player 25 hand |
| 34 | game table 34 |
| 35 | console ON button |
| 36 | water spray from console |
| 37 | plastic rods |
| 38 | nozzle (console) |
| 39 | turret (console) |
| 40 | playhat circuitry |
| 41 | battery |
| 42 | speaker |
| 43 | circuit board (hat) |
| 44 | LED's |
| 45 | solenoid controller on circuit board |
| 46 | motor |
| 47 | pump |
| 48 | blaster gun circuitry |
| 49 | circuit board (gun) |
| 50 | beam transmitter |
| 51 | signal receiver |
| 52 | hat strap |
| 53 | water container top section |
| 54 | water container bottom section |
| 55 | reservoir bottom |
| 58 | blaster gun housing half |
| 59 | blaster gun housing half |
| 60 | batteries (gun) |
| 61 | electronic circuitry schematic for console |
| 62 | speaker |
| 63 | Console LED lights |
| 64 | Console transmitter |
| 65 | Console circuit board |
| 66 | Console housing top |
| 67 | Console housing bottom |
| 68 | Console Game button switch |
| 69 | Console button switches |
| 70 | console battery door |
| 72 | Console master ON/OFF switch |
| 73 | Console wireless signal transmitter |
| 74 | Console batteries |
| 75 | Console battery contacts |
| 76 | Console integrated circuit board |
| 77 | Console battery door screw |
| 78 | playhat loop fastener strip |
| 79 | playhat hook fastener strip |
| 80 | playhat wireless signal access portal |
| 81 | playhat water tube |
| 82 | playhat solenoid |
| 83 | playhat reservoir bottom water coupling |
| 85 | playhat pivoting valve plate |

-continued

| Part Number | Part |
|---|---|
| 86 | playhat battery door |
| 87 | playhat battery door screw |
| 88 | playhat battery contacts |
| 89 | playhat reservoir bottom hole |
| 90 | playhat flexible seal |
| 91 | playhat target area sidewall. |
| 92 | blaster gun circuitry trigger switch |
| 93 | console speaker |
| 100 | transmitter |
| 101 | handle |

What is claimed is:

1. A gameset configured to emit a liquid onto a player comprising:

a hat configured to be worn on a head of a player and comprising a receiver, a liquid reservoir configured to hold a liquid, and a valve controlled by a solenoid or by a motor;

a remote device comprising a transmitter configured to transmit a wireless signal to the receiver; and one or more power sources configured to power the transmitter and the receiver, wherein, upon reception of the wireless signal from the transmitter, the receiver is configured to automatically cause the valve to open and dispense the liquid from the liquid reservoir downward onto the player's head, said dispensing aided and not hindered by gravity.

2. The gameset of claim 1, wherein the hat is in the form of a helmet comprising a chin strap configured to strap the helmet to a chin of the player.

3. The gameset of claim 1 wherein the remote device is a toy blaster gun comprising a handle and a trigger and further wherein the wireless signal is an infrared signal.

4. The gameset of claim 1 wherein, upon reception of the wireless signal from the transmitter, the receiver is configured to automatically cause the valve to open and dispense the liquid from the liquid reservoir downward onto the player's head without a pump, said dispensing aided and not hindered by gravity.

5. The gameset of claim 1 wherein the hat is further configured to emit lights, sounds or combinations thereof in response to the receiver receiving the wireless signal.

6. The gameset of claim 1 wherein the remote device is a mobile phone.

7. The gameset of claim 1 wherein the hat further comprises at least one dispenser configured to dispense the liquid from the liquid reservoir onto the player's head when the receiver receives the wireless signal from the transmitter.

8. The gameset of claim 7, wherein the at least one dispenser comprises at least one tube comprising a proximal end connected to the liquid reservoir and a distal end and further wherein the at least one tube is configured to transport the liquid from the liquid reservoir.

9. The gameset of claim 7, wherein the at least one dispenser comprises at least one tube and at least one spray nozzle and further wherein the at least one tube comprises a proximal end connected to the liquid reservoir and a distal end connected to the at least one spray nozzle and further wherein the at least one tube is configured to transport the liquid from the liquid reservoir to the at least one spray nozzle and onto the player's head.

10. A method of play comprising the steps of:

a) providing the gameset of claim 1;

b) placing the hat on a player's head;

c) transmitting a wireless signal from the transmitter to the receiver; and d) dispensing liquid from the liquid reservoir onto the player's head in response to the receiver receiving the wireless signal from the transmitter.

11. The method of play of claim 10 wherein the method further comprises at least one player playing a gameplay sequence before step c).

12. The method of play of claim 10 wherein said transmitter is located on a handheld remote device further comprising at least one switch and the method further comprises at least one player manipulating the at least one switch before step c).

13. The method of play of claim 12 wherein the handheld remote device is a mobile phone and the at least one switch is an electronic switch activated by at least one player playing a game app on the mobile phone.

14. The method of play of claim 10 wherein the transmitter is located on a remote device that further comprises at least one switch and the method further comprises at least one player manipulating the at least one switch in accord with a programmed gaming sequence before step c).

15. The method of play of claim 10 wherein the transmitter is located on an electronic tabletop game console that further comprises at least one switch and method further comprises manipulating the at least one switch, prior to step c) to identify the position of the hat relative to the electronic tabletop game console.

16. A method of play comprising the steps of a) providing a game set configured to emit a liquid onto a player comprising:

i) a hat configured to be worn on a head of a player and comprising a receiver, a liquid reservoir holding a liquid, and a valve controlled by a solenoid or by a motor;

ii) a remote device in the form of a toy blaster gun comprising a handle, a trigger, and a transmitter configured to transmit a wireless signal to the receiver; and iii) one or more power sources configured to power the transmitter and the receiver;

b) placing the hat on a first player's head;

c) placing the toy blaster gun in a player's hand, aiming the toy blaster gun at the receiver and activating the trigger on the toy blaster gun to send a wireless signal from the transmitter to the receiver; and d) in response to the receiver receiving the wireless signal from the transmitter, the receiver automatically causing the mechanically-controlled valve to open and dispense the liquid from the liquid reservoir downward onto the first player's head, said dispensing aided and not hindered by gravity.

17. The method of play of claim 16 wherein a player different than the first player performs step c).

18. The method of play of claim 17 wherein the wireless signal is in the form of an infrared signal.

19. The method of play of claim 16 wherein, step d) comprises, in response to the receiver receiving the wireless signal from the transmitter, the receiver automatically causing the valve to open and dispense the liquid from the liquid reservoir downward onto the player's head without a pump, said dispensing aided and not hindered by gravity.

20. The method of play of claim 16 wherein step b) comprises placing the hat on a first player's head so that the liquid reservoir is located above the first player's head.

21. A method of play comprising the steps of:

a) placing a hat comprising a receiver and a liquid reservoir comprising a liquid on a layer's head so that the liquid reservoir is located above the player's head;

b) providing a remote device comprising a transmitter configured to transmit a wireless signal to the receiver, the remote device configured to allow the player to perform a pre-determined gaming sequence;

(c) sending a wireless signal from the transmitter to the receiver of the hat after the player fails to perform the predetermined sequence; and (d) the hat, upon reception of the wireless signal from the transmitter, automatically dispensing the liquid from the liquid reservoir downward onto the head of the player, said dispensing aided and not hindered by gravity.

22. The method of play of claim 21 wherein the remote device is an electronic gaming console comprising a plurality of lighted buttons and further wherein the pre-determined gaming sequence comprises pushing the plurality of lighted buttons in a sequence.

23. The method of play of claim 21 wherein the remote device is a mobile phone.

24. The method of play of claim 23 wherein the wireless signal comprises Bluetooth.

25. The method of play of claim 21 further comprising the step of (e) placing the hat on the head of another player after step d).

26. The method of play of claim 21 wherein the remote device is located on a table.

27. The method of play of claim 21 further comprising the step of emitting a sound prior to or contemporaneous with step (d).

28. The gameset of claim 1 wherein the one or more power sources comprises a first power source configured to power the transmitter and a second power source configured to power the receiver.

* * * * *